US011308888B2

(12) United States Patent
Yuan et al.

(10) Patent No.: US 11,308,888 B2
(45) Date of Patent: Apr. 19, 2022

(54) PIXEL SCAN DRIVE CIRCUIT, ARRAY SUBSTRATE AND DISPLAY TERMINAL

(71) Applicant: SHENZHEN ROYOLE TECHNOLOGIES CO., LTD., Guangdong (CN)

(72) Inventors: Ze Yuan, Guangdong (CN); Jiahao Kang, Guangdong (CN); Shaowen Wang, Guangdong (CN); Yao Yan, Guangdong (CN)

(73) Assignee: SHENZHEN ROYOLE TECHNOLOGIES CO., LTD., Shenzhen (CN)

( * ) Notice: Subject to any disclaimer, the term of this patent is extended or adjusted under 35 U.S.C. 154(b) by 0 days.

(21) Appl. No.: 17/132,839

(22) Filed: Dec. 23, 2020

(65) Prior Publication Data

US 2021/0193050 A1 Jun. 24, 2021

(30) Foreign Application Priority Data

Dec. 23, 2019 (CN) ..... 201911340154.4

(51) Int. Cl.
*G09G 3/3266* (2016.01)
*G09G 3/3258* (2016.01)

(52) U.S. Cl.
CPC ..... *G09G 3/3266* (2013.01); *G09G 3/3258* (2013.01); *G09G 2300/0408* (2013.01); *G09G 2310/08* (2013.01); *G09G 2320/0233* (2013.01)

(58) Field of Classification Search
CPC combination set(s) only.
See application file for complete search history.

(56) References Cited

U.S. PATENT DOCUMENTS

| | | | | |
|---|---|---|---|---|
| 7,522,145 | B2 * | 4/2009 | Lee | G11C 19/00 345/100 |
| 10,957,230 | B2 * | 3/2021 | Zheng | G09G 3/20 |
| 2017/0025068 | A1 * | 1/2017 | Jeoung | G09G 3/3677 |
| 2017/0052635 | A1 * | 2/2017 | Yu | G09G 3/20 |
| 2018/0240431 | A1 | 8/2018 | Fei | |

OTHER PUBLICATIONS

The Extended European Search Report issued corresponding EP Application No. EP 20217012.2, dated Apr. 14, 2021, pp. 1-20, European Patent Office, Munich, Germany.

* cited by examiner

*Primary Examiner* — Van N Chow
(74) *Attorney, Agent, or Firm* — JCIP Global Inc.

(57) ABSTRACT

A pixel scan drive circuit including a switch unit, a pull-up output unit and a pull-down output unit is provided. In a scan signal output phase of a scanning cycle, the pull-down output unit outputs a first reference voltage in a scan signal to an output end according to a clock signal. In a maintenance phase of the scanning cycle, the switch unit controls the voltage of a pull-down node according to a switch control signal, thereby controlling the pull-down output unit to stop outputting the first reference voltage. In the maintenance phase, the pull-up output unit outputs a second reference voltage in the scan signal. The second reference voltage controls the pixel units to stop receiving the image data. Transistors in the switch unit are of different types from transistors in the pull-up output unit and the pull-down output unit. An array substrate and a display terminal are provided.

17 Claims, 16 Drawing Sheets

PIXEL SCAN DRIVE CIRCUIT, ARRAY SUBSTRATE AND DISPLAY TERMINAL

CROSS-REFERENCE TO RELATED APPLICATIONS

This application claims priority to China Patent Application No. 201911340154.4, filed on Dec. 23, 2019, the content of which is hereby incorporated by reference in its entirety.

TECHNICAL FIELD

The present disclosure relates to a field of display drive, in particular to a pixel scan drive circuit, an array substrate and a display terminal.

BACKGROUND

With the development of display technology, an Organic Light Emitting Diode (OLED) display panel, as a new generation of the display technology, has attracted considerable market attention due to its merits such as high resolution, high brightness, high resolution and fast response time, which has become one of mainstream developments in modern display panels.

A Gate Driver on Array (GOA) technology is usually used for a pixel scan drive circuit of the OLED display panel, and the GOA technology is a technology that integrates gate drive circuits on a display array substrate of a liquid crystal display device by use of photolithography. The pixel scan drive circuit includes a number of thin-film transistors and a number of capacitors. At present, types of thin-film transistors (TFTs) in the pixel scan drive circuit are identical, such as N-type TFTs or P-type TFTs, namely, the N-type TFTs thin-film transistors only or the P-type TFTs only are used. However, when the TFTs in the pixel scan drive circuit are all the P-type TFTs, refresh rate cannot be reduced and power consumption of the OLED display panel is large when pixel units are performing image display due to large leakage current. When the TFTs in the pixel scan drive circuit are all the N-type TFTs, display brightness of the same image data in different pixel units is not exactly the same due to the drift of the TFTs, so that the image data cannot be displayed uniformly. Moreover, the current pixel scan drive circuit is prone to interference with other image data when performing the image display, which further leads to the image data cannot be displayed correctly, resulting in poor image display effect.

SUMMARY

To solve the above problems, the present disclosure provides a pixel scan drive circuit with better display effect.

The present disclosure provides a pixel scan drive circuit, used to output a scan signal to pixel units, the pixel scan drive circuit includes a switch unit, a pull-up output unit and a pull-down output unit. A scanning cycle in a display phase of one frame image includes a scan signal output phase and a maintenance phase. In the scan signal output phase, the pull-down output unit outputs a first reference voltage in the scan signal to an output end according to a clock signal, the first reference voltage is configured to control the pixel units to receive image data for image display. The switch unit is electrically connected to the pull-down output. In the maintenance phase, the switch unit controls the voltage of a pull-down node according to received switch control signal, and controls the pull-down output unit to stop outputting the first reference voltage according to the voltage of the pull-down node. The switch control signal is an input signal of the pixel scan drive circuit. In the maintenance phase, the pull-up output unit outputs a second reference voltage in the scan signal, and the second reference voltage is configured to control the pixel units to stop receiving the image data. Transistors included in the switch unit are of different types from transistors included in the pull-up output unit and the pull-down output unit.

The present disclosure further provides an array substrate, the array substrate includes a display area and a non-display area. The display area is provided with a plurality of pixel units, and the non-display area is provided with a scan driver module. The scan driver module includes a plurality of pixel scan drive circuits as described above, the plurality of pixel scan drive circuits cascade to each other.

The present disclosure further provides a display terminal, the display terminal includes the array substrate as described above.

Compared with the existing technology, the switch unit can accurately control the pull-down output unit to stop outputting the first reference voltage in the scan signal in the maintenance phase in a scanning cycle, and the first reference voltage is used to control the pixel units to receive the image data, so that the pixel units can accurately perform image display according to the received image data in the maintenance phase, which can effectively protect the pixel units from the interference of other signals when the pixel units are executed to display the image data, and ensure the accuracy of the image data.

Furthermore, when the transistor in the switch unit is an N-type transistor, while one of the transistors in the pull-up output unit, the pull-down output unit, the pull-down unit and the start unit adopts a P-type transistor, not all transistors adopt a single N-type thin-film transistor or P-type thin-film transistor. The P-type transistor can accurately receive a voltage with a fixed value and has a big drive current, which can reduce the border area occupied by the pixel scan drive circuit. The N-type thin-film transistor can accurately and quickly adapt to the refresh rate of different image data when displaying at high and low speeds. Moreover, because the leakage current is small, the pixel scan drive circuit can accurately suppress the voltage drift of itself and the display unit, effectively reducing the power consumption and having a better display effect.

Moreover, the P-type low temperature polycrystalline oxide transistors used in the pull-up output unit, the pull-down output unit, the pull-down unit and the start unit have strong driving abilities, which can quickly adapt to the refresh rate of different image data when displaying at high and low speeds.

BRIEF DESCRIPTION OF THE ACCOMPANYING DRAWINGS

In order to more clearly explain the technical solutions of the embodiments of the present disclosure, the drawings required in the embodiments will be briefly introduced below. Obviously, the drawings in the following description are some embodiments of the present disclosure. In terms of technicians, other drawings can be obtained based on these drawings without any creative work.

DETAILED DESCRIPTION OF ILLUSTRATED EMBODIMENTS

The technical solutions in the embodiments of the present disclosure will be described clearly and completely with reference to the drawings in the embodiments of the present disclosure. Obviously, the described embodiments are only a part of the embodiments of the present disclosure, but not all the embodiments. Based on the embodiments of the present disclosure, all other embodiments obtained by those of ordinary skill in the art without paying any creative work fall within the protection scope of the present disclosure.

Figure 1:
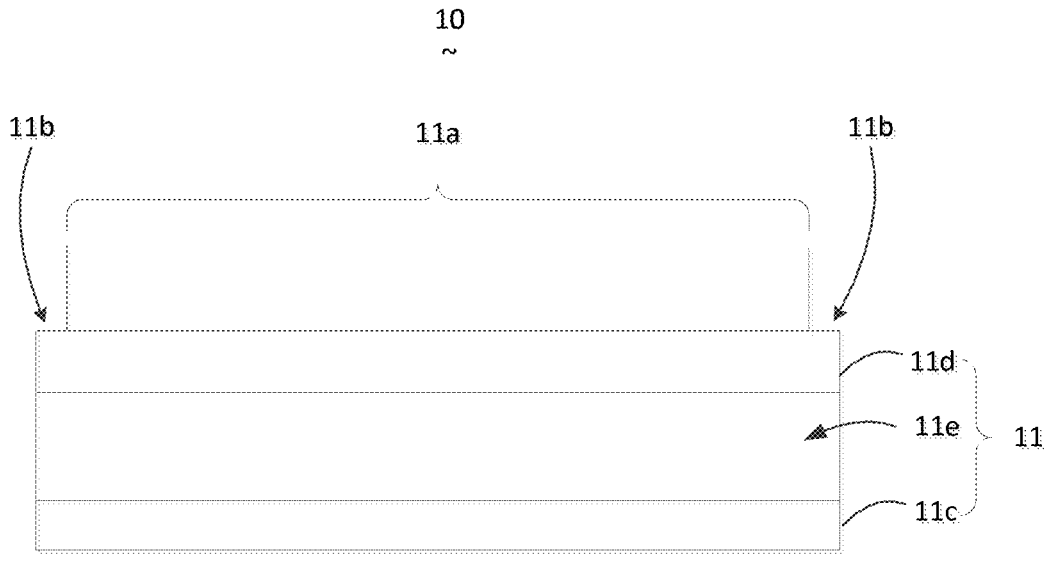
FIG. 1 is a side-structure diagram of a display terminal according to one embodiment of the present disclosure.

Please refer to FIG. 1, FIG. 1 is a side-structure diagram of a display terminal 10 according to one embodiment of the present disclosure. As shown in FIG. 1, the display terminal 10 includes a display panel 11 and other component parts (not shown in FIG. 1). The other component parts include a power module, a signal processor module, a signal sensor module, etc.

The display panel 11 includes a display area 11*a* for image display and a non-display area 11*b*. The display area 11*a* is configured to perform image display, that is, the display area 11*a* is used to display images. The non-display area 11*b* is arranged around the display area 11*a*, and is designed to be used for mounting other auxiliary parts or modules. Specifically, the display panel 11 further includes an array substrate 11*c*, an opposite substrate 11*d*, and a display medium layer 11*e* sandwiched between the array substrate 11*c* and the opposite substrate 11*d*. In this embodiment, a display medium in the display medium layer 11*e* is a Organic Electroluminescence Diode (OLED) material.

Figure 2:
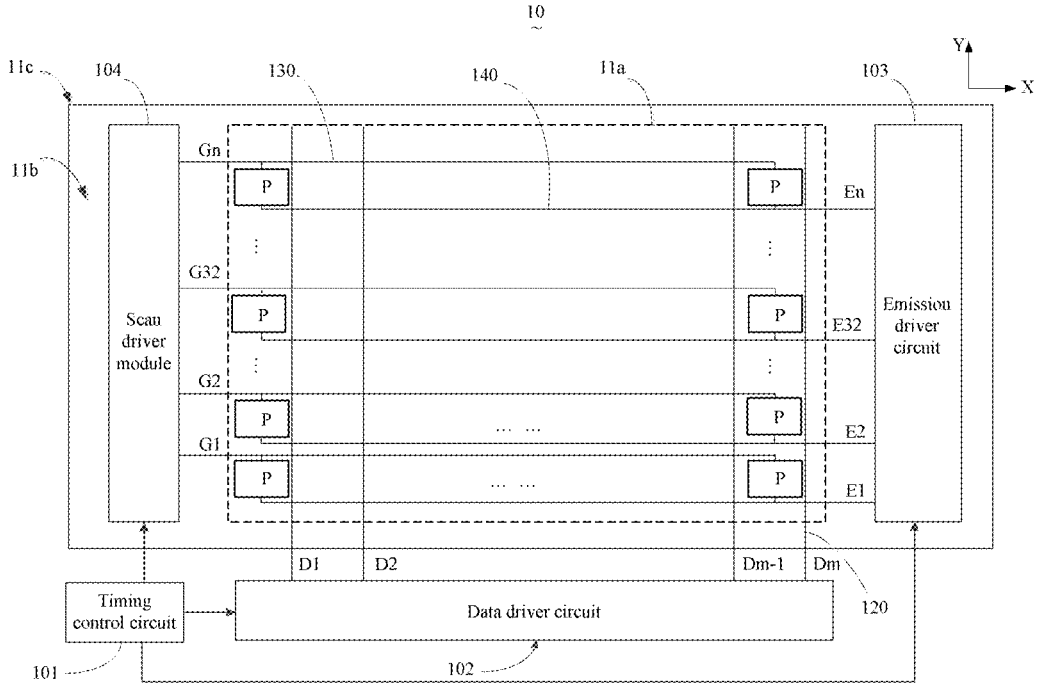
FIG. 2 is a planar diagram of an array substrate of a display panel as shown in FIG. 1.

Please refer to FIG. 2, FIG. 2 is a planar structure diagram of the array substrate 11*c* of the display panel 11 as shown in FIG. 1. As shown in FIG. 2, the array substrate 11*c* includes m*n pixel units P arranged in a matrix, m data lines 120, n scan lines 130, and n emission lines 140. The m*n pixel units P, the m data lines 120, the n scan lines 130, and the n emission lines 140 correspond to the position of the display area 11*a*. Wherein, m and n are natural numbers greater than 1.

The m data lines 120 are arranged in parallel along a second direction Y, and are separated by a first predetermined distance and insulated from each other. The n scan lines 130 are arranged in parallel along a first direction X, and are separated by a second predetermined distance and insulated from each other. The n emission lines 140 are arranged in parallel along the first direction X, and are separated by the second predetermined distance and insulated from each other. The n scan lines 130 and the n emission lines 140 are insulated with the m data lines 120 from each other. The first direction X is perpendicular to the second direction Y.

For the convenience of illustration, the m data lines 120 are respectively defined as D1, D2, . . . , Dm-1, Dm, in a position order; the n scan lines 130 are respectively defined in a position order as G1, G2, . . . , G32, . . . , Gn; the n emission lines 140 are respectively defined as E1, E2, . . . , E32, . . . , En in a position order. Each pixel unit P is electrically connected to a scan line 130 and an emission line 140 both of which are extended along the first direction X and a data line 120 which is extended along the second direction Y, correspondingly.

The display terminal 10 further includes a scan driver module 104, a timing control circuit 101, a data driver circuit 102, and an emission driver circuit 103. The scan driver module 104, the timing control circuit 101, the data driver circuit 102 and the emission driver circuit 103 are used to drive the pixel units P for image display cooperatively. The scan driver module 104 and the emission driver circuit 103 are located on the array substrate 11*c* and correspond to the position of the non-display area 11*b*.

The data driver circuit 102 is electrically connected to the data lines 120 and is configured to transmit the image data to be displayed to the pixel units P in the form of data voltage by use of the plurality of data lines 120.

The scan driver module 104 is electrically connected to the scan lines 130 and is configured to output scan signals Gn to the pixel units P through the scan lines 130 to control when the pixel units P receive the image data. In detail, the scan driver module 104 can output the scan signals G1, G2, . . . , G32, . . . , Gn to corresponding pixel units P through the scan lines 130 (including the scan lines G1, G2, . . . , G32, . . . , Gn arranged in position order) in accordance with a scanning cycle. For example, the scan driver module 104 output the scan signal G1 to the pixel units P by use of the scan line G1, the scan driver module 104 output the scan signal G2 to the pixel units P by use of the scan line G2, the scan driver module 104 output the scan signal G32 to the pixel units P by use of the scan line G32, and the scan driver module 104 output the scan signal Gn to the pixel units P by use of the scan line Gn.

The emission driver circuit 103 is electrically connected to the emission lines 140 and is configured to output initial signals En to the pixel units P through the emission lines 140 to control when the pixel units P emit light according to received image data. In detail, the emission driver circuit 103 can output the initial signals E1, E2, . . . , E32, . . . , En to corresponding pixel units P through the emission lines 140 (including the emission lines E1, E2, . . . , E32, . . . , En arranged in the position order) in accordance with the scanning cycle. For example, the emission driver circuit 103 outputs the initial signal E1 to the pixel units P by use of the emission line E1, the emission driver circuit 103 outputs the initial signal E2 to the pixel units P by use of the emission line E2, the emission driver circuit 103 outputs the initial signal E32 to the pixel units P by use of the emission line E32, the emission driver circuit 103 outputs the emission signal En to the pixel units P by use of the emission line En.

The timing control circuit 101 is electrically connected to the data driver circuit 102, the scan driver module 104 and the emission driver circuit 103 respectively, and is configured to control working sequences of the data driver circuit 102, the scan driver module 104 and the emission driver circuit 103. That is, the timing control circuit 101 can output corresponding timing control signals to the scan driver module 104, the data driver circuit 102 and the emission driver circuit 103 to control when the scan signals Gn and the initial signals En are output.

In this embodiment, circuit elements in the scan driver module 104 and the pixel units P in the display panel 11 are made in the display panel 11 by use of the same process, namely, the Gate Driver on Array (GOA) technology.

It should be understandable that the display terminal 10 further includes other auxiliary circuits for jointly completing image display, such as, Graphics Processing Unit (GPU), power circuit, etc., which will not be repeated in this embodiment.

Figure 3:
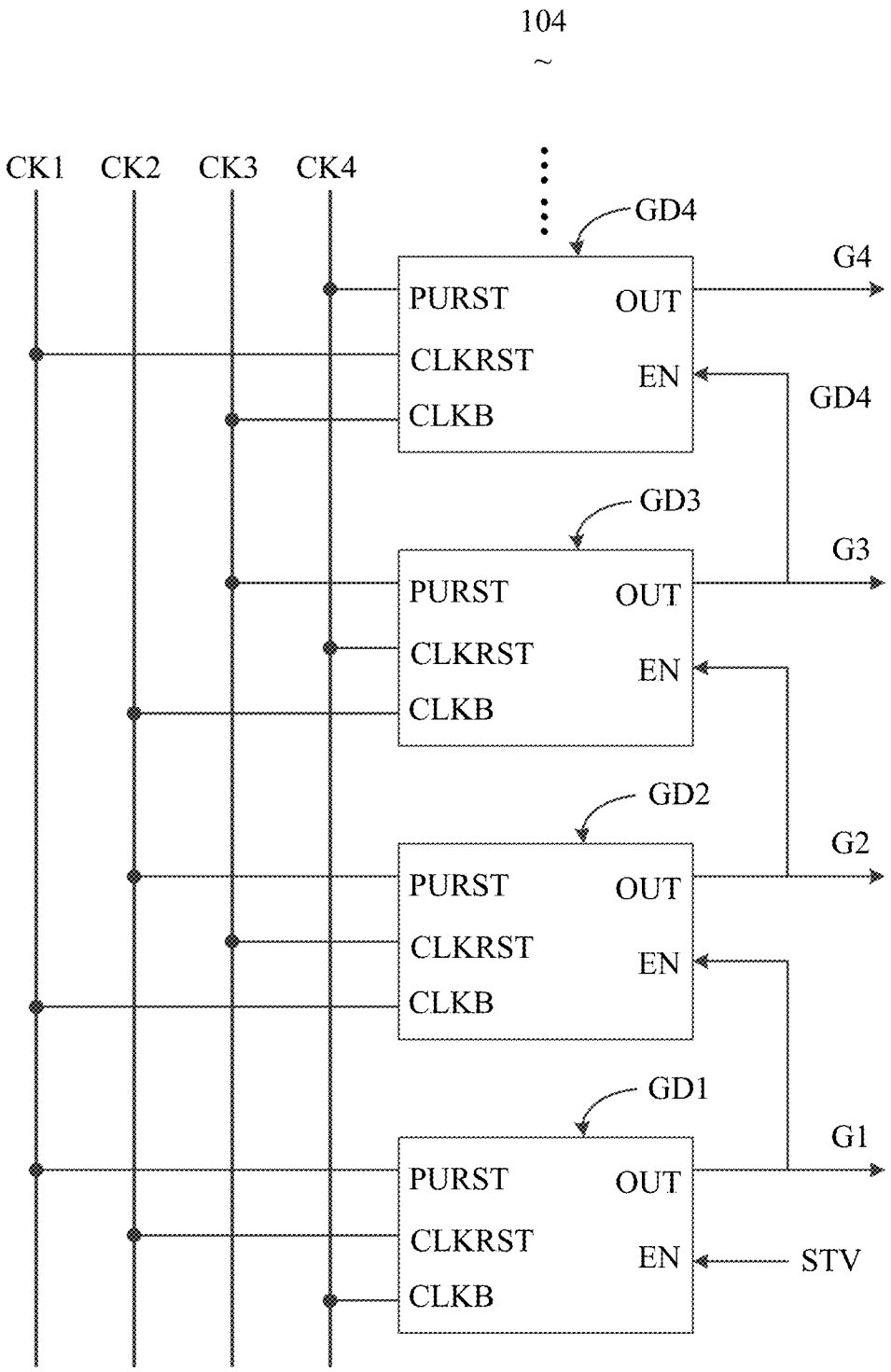
FIG. 3 is a structure diagram of a scan driver module as shown in FIG. 2.

Please refer to FIG. 3, FIG. 3 is a structure diagram of the scan driver module as shown in FIG. 2. As shown in FIG. 3, the scan driver module 104 includes a plurality of scan driver circuits GD1-GDn, and each scan driver circuit cascades to each other. Besides the last level scan driver circuit GDn, an output end OUT of each scan driver circuit is connected to an input end EN of an adjacent next level scan driver circuit. For example, the output end OUT of the scan driver circuit GD1 is connected to the input end EN of the scan driver circuit GD2. The output end OUT of each scan driver circuit can output the scan signals G1, G2, G3, G4, which are used to drive the scan lines of corresponding row pixels in a display array substrate. In detail, a starting signal STV is an input signal of the first scan driver circuit GD1 of the scan driver module 104, the timing control circuit 101 can output a first clock signal CK1, a second clock signal CK2, a third clock signal CK3 and a fourth clock signal CK4 to the scan driver circuits of the scan driver module 104 for providing the clock signals. More specifically, each scan driver circuit in the scan driver module 104 further includes a first signal end PURST, a second signal end CLKRST and a third signal end CLKB, and the first signal end PURST, the second signal end CLKRST and the third signal end CLKB in any scan driver circuit are connected to different clock signal lines. In any of four adjacent scan driver circuits, the first signal end PURST of each scan driver circuit is connected to different clock signal lines, the second signal end CLKRST of each scan driver circuit is connected to different clock signal lines, and the third signal end CLKB of each scan driver circuit is connected to different clock signal lines.

In the scan driver module 104, one shift register unit can be used to drive a corresponding row of pixels in the display array substrate, and the number of the scan driver circuits is equal to the number of rows of pixels in the drive display array substrate. When one shift register unit is used to drive multiple rows of pixels in the display array substrate, the number of the shift register units may not be equal to the number of rows of the pixels in the drive display array substrate.

Figure 4:
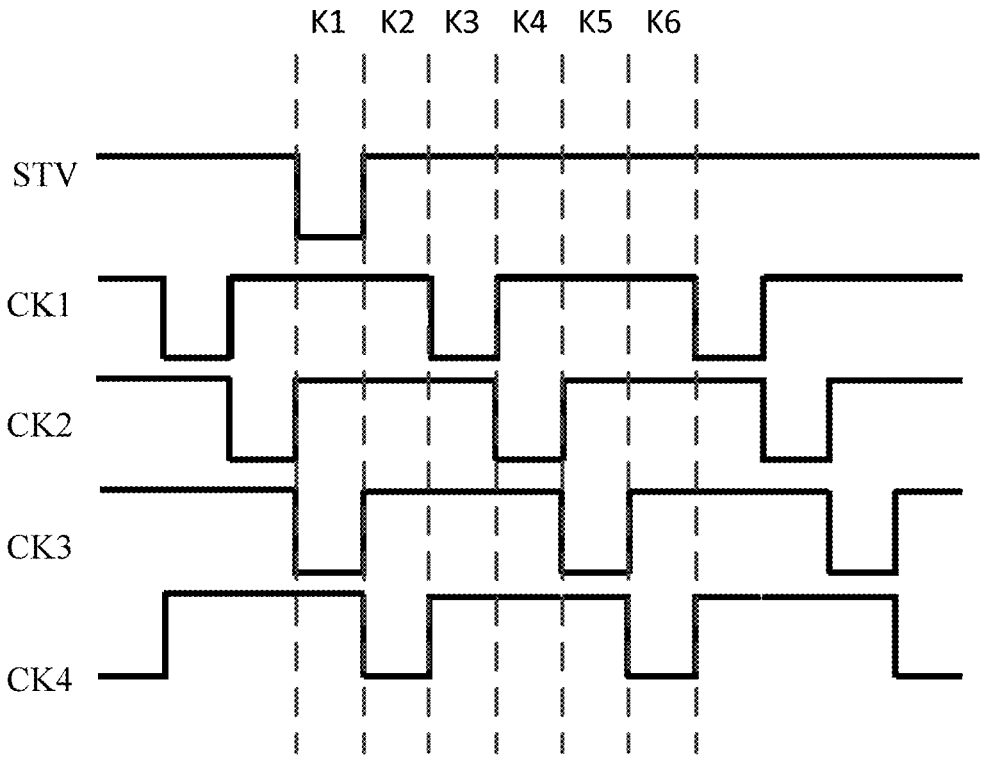
FIG. 4 is a timing diagram of clock signals of the scan driver module during an image display process of one frame as shown in FIG. 3.

Please refer to FIG. 4, FIG. 4 is a timing diagram of clock signals of the scan driver module during an image display process of one frame as shown in FIG. 3. As shown in FIG. 4, STV is the starting signal of a first frame image of the first scan driver circuit GD1 in the scan driver module 104. CK1, CK2, CK3 and CK4 are respectively represented as the first clock signal CK1, the second clock signal CK2, the third clock signal CK3 and the fourth clock signal CK4. An image display process of one frame of the scan driver module 104 includes six stages of K1-K6, including: a first stage K1, a second stage K2, a third stage K3, a fourth stage K4, a fifth stage K5, and a sixth stage K6. The six stages of K1-K6 are arranged in a time sequence and do not overlap.

In the first stage K1, the starting signal STV and the third clock signal CK3 are both at low level, while the first clock signal CK1, the second clock signal CK2 and the fourth clock signal CK4 are all at high level. In the second stage K2, the starting signal STV, the first clock signal CK1, the second clock signal CK2 and the third clock signal CK3 are all at the high level, while the fourth clock signal CK4 is at the low level. In the third stage K3, the starting signal STV, the second clock signal CK2, the third clock signal CK3 and the fourth clock signal CK4 are all at the high level, while the first clock signal CK1 is at the low level. In the fourth stage K4, the starting signal STV, the first clock signal CK1, the third clock signal CK3 and the fourth clock signal CK4 are all at the high level, while the second clock signal CK2 is at the low level. In the fifth stage K5, the starting signal STV, the first clock signal CK1, the second clock signal CK2 and the fourth clock signal CK4 are all at the high level, while the third clock signal CK3 is at the low level. In the sixth stage K6, the starting signal STV, the first clock signal CK1, the second clock signal CK2 and the third clock signal CK3 are all at the high level, while the fourth clock signal CK4 is at the low level.

Figure 5:
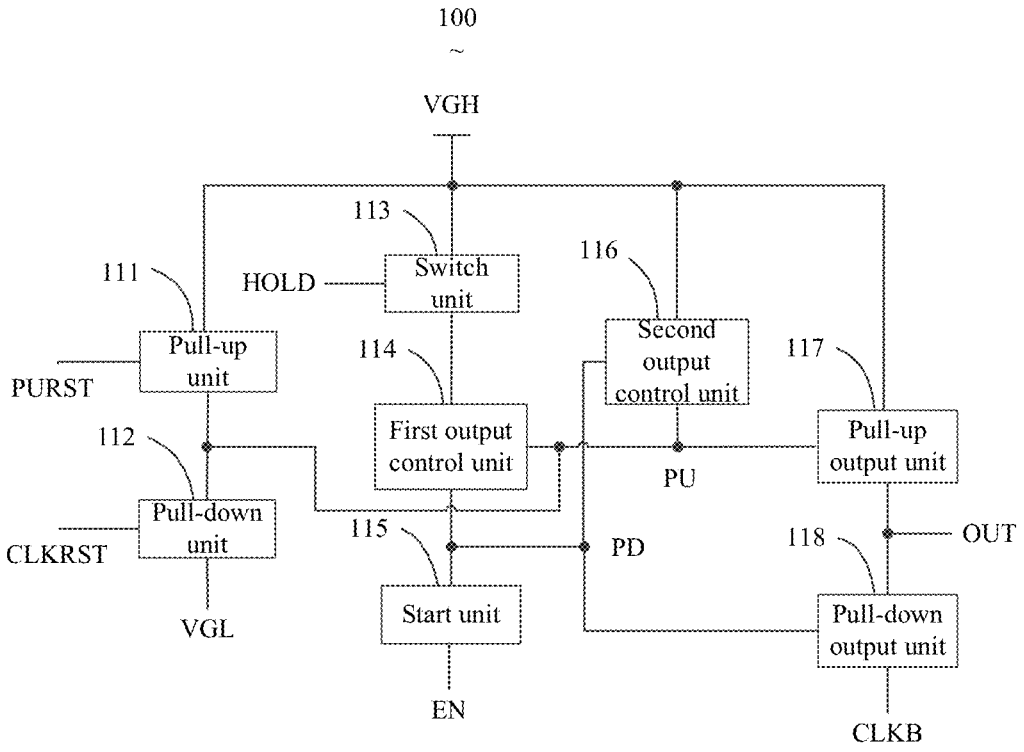
FIG. 5 is a circuit block diagram of any pixel scan drive circuit in the scan driver module as shown in FIG. 2 according to a first embodiment of the present disclosure.

Please referring to FIG. 5, FIG. 5 is a circuit block diagram of a pixel scan drive circuit in the scan driver module 104 as shown in FIG. 2 according to a first embodiment of the present disclosure. As shown in FIG. 5, the pixel scan drive circuit 100 includes: a pull-up unit 111, a pull-down unit 112, a switch unit 113, a first output control unit 114, a start unit 115, a second output control unit 116, a pull-up output unit 117, and a pull-down output unit 118. One scanning cycle of the pixel scan drive circuit 100 includes seven sequential and uninterrupted time phases of T1-T7. In detail, T1 is an initial phase, T2 is a scanning phase, T3 is a pull-down phase, T4 is a reset phase, T5 is a first maintenance phase, T6 is a second maintenance phase, and T7 is a pull-up phase. In this embodiment, the scanning phase T2 and the pull-down phase T3 represent a scan signal output phase of a scanning cycle. The first maintenance phase T5 and the second maintenance phase T6 represent a maintenance phase of a scanning cycle. In this embodiment, a refresh rate of the pixel scan drive circuit 100 is 1 Hz-120 Hz, namely, the refresh rate of the pixel scan drive circuit 100 ranges at 1 Hz-120 Hz. Preferably, the refresh rate of the pixel scan drive circuit 100 can be 30 Hz, 60 Hz and 90 Hz. The refresh rate refers to the frequency of the scan signal or the frequency at which pixel scan drive circuit operates. When the pixel scan drive circuit 100 continuously outputs the scan signals to the pixel units, the refresh rate of the pixel scan drive circuit 100 can be dynamically adjusted by changing the frequency of a switch control signal HOLD. In this embodiment, the pixel scan drive circuit 100 can be dynamically adjusted within a frequency range of 1 Hz-120 Hz. The frequency of the switch control signal HOLD is equal to the product of the refresh rate of the pixel units and the number of the scan driver circuits, or it can be expressed as: when the number of the scan driver circuits corresponds to the number of the scan lines 130, the frequency of the switch control signal HOLD is equal to the product of the refresh rate of the pixel units and the number of the scan lines 130.

Figure 6:
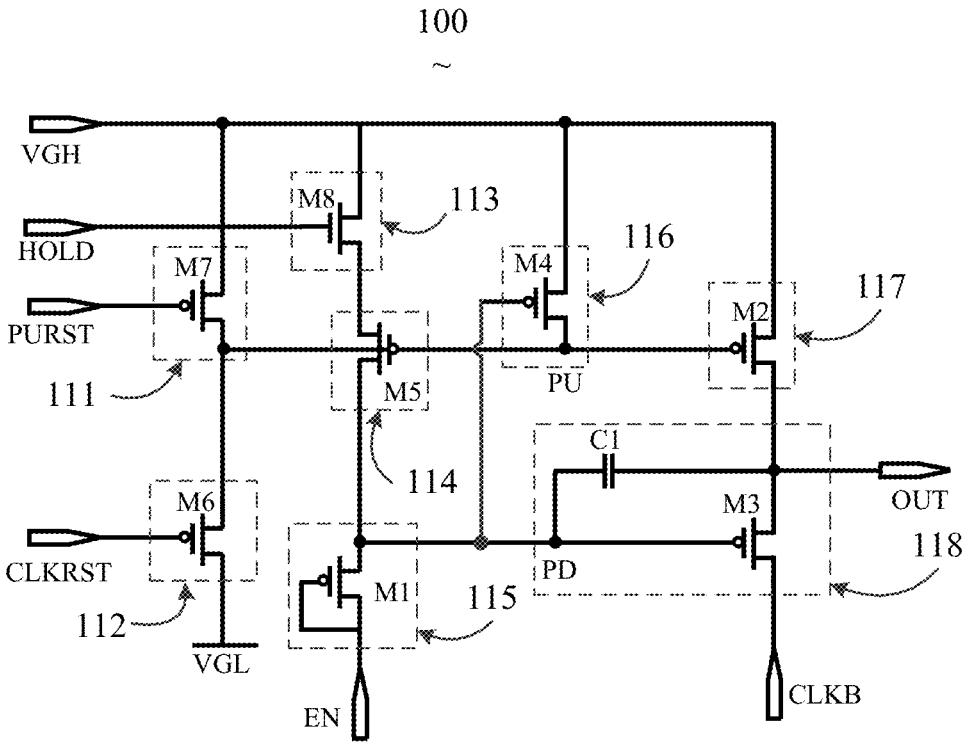
FIG. 6 is a circuit structure diagram of the pixel scan drive circuit as shown in FIG. 5.

As shown in FIGS. 5 and 6, the pull-up unit 111 is electrically connected to a pull-up node PU, and is configured to maintain the pull-up node PU as a second reference voltage Vgh in the pull-up phase T3 according to a received pull-up signal PURST, and configured to control the pull-up node PU from a first reference voltage Vgl to the second reference voltage Vgh in the pull-up phase T7 according to the received pull-up signal PURET.

The pull-down unit 112 is electrically connected to the first output control unit 114 via the pull-up node PU and is configured to write the first reference voltage Vgl into the pull-up node PU in the reset phase T4 according to the reset signal CLKRST received, and control the pull-up node PU from the high level to the low level.

The switch unit 113 is electrically connected to the pull-down output unit 118 via the first output control unit 114. The switch unit 113 is configured to transmit the second reference voltage Vgh to a pull-down node PD during the maintenance phase of a scanning cycle according to the switch control signal HOLD received, to control the pull-down output unit 118 to stop outputting a clock signal CLKB which is taken as the first reference voltage Vgl of the scan signal. The scan signal is used for the pixel units to receive the image data for image display. When the scan signal is the first reference voltage Vgl, the pixel units begin to receive the image data. When the scan signal is the second reference voltage Vgh, the pixel units stop receiving the image data.

The first output control unit 114 is electrically connected to the pull-up output unit 117 through the pull-up node PU, and is configured to transmit the second reference voltage Vgh to the pull-down node PD during the maintenance stage according to the voltage of the pull-up node PU and control the pull-down node PD to rise from the low level to the high level. The start unit 115 is electrically connected to the second output control unit 116 and the pull-down output unit 118 through the pull-down node PD, and is configured to output the initial signal En to the pull-down node PD during the scan signal output phase of a scanning cycle and control the voltage of the pull-down node PD from the high level to the low level.

The second output control unit 116 is electrically connected to the pull-up node PU. The second output control unit 116 is configured to be switched on according to a low level of the pull-down node PD during the scan signal output phase of a scanning cycle, and output the second reference voltage Vgh to the pull-up node PU to control the pull-up node PU to rise from the low level to the high level.

The pull-up output unit 117 is electrically connected to the output end OUT, and is configured to be switched on according to the voltage of the pull-up node PU during the maintenance phase to output the second reference voltage Vgh in the scan signal. The second reference voltage Vgh is configured to control the pixel units to stop receiving the image data.

The pull-down output unit 118 is electrically connected to the output end OUT, and is configured to be switched on according to the voltage of the pull-down node PD during the scan signal output phase of a scanning cycle to output the clock signal CLKB which is taken as the first reference voltage Vgl of the scan signal to the output end OUT. The first reference voltage Vgl is configured to control the pixel units to receive the image data for image display.

In this embodiment, the transistors used in the switch unit 113 are of different types from the transistors included in the pull-up output unit 117 and the pull-down output unit 118, namely, the transistors used in the switch unit 113 are different from the transistors included in the pull-up output unit 117 and the pull-down output unit 118. The types of the transistors are channel types, including N-channel and P-channel, therefore, the transistors include N-type thin-film transistors and P-type thin-film transistors correspondingly. The leakage current of an N-type metal oxide thin-film transistor in the switch unit 113 is less than $10^{-12}$ A.

In detail, the pull-up node PU can be used as an input control end of the first output control unit 114 and an input control end of the pull-up output unit 117, and the pull-down node PD can be used as an input control end of the second output control unit 116 and an input control end of the pull-down output unit 118. The pull-up node PU and the pull-down node PD are both internal control signal nodes in the pixel scan drive circuit 100.

In this embodiment, the first reference voltage Vgl of the scan signal is the low level, and the second reference voltage Vgh of the scan signal is the high level. The pull-up signal PURST, the reset signal CLKRST, the switch control signal HOLD, the initial signal En and the clock signal CLKB are all external control signals received by the pixel scan drive circuit 100.

Please referring to FIG. 6, which is a circuit structure diagram of the pixel scan drive circuit as shown in FIG. 5. As shown in FIG. 6, it should be noted that the pixel scan drive circuit 100 is any pixel scan drive circuit that is used to output any scan signal Gn in line n.

In detail, the pull-up unit 111 includes a seventh transistor M7 which includes a gate, a drain and a source. The gate of the seventh transistor M7 receives the pull-up signal PURST, the drain of the seventh transistor M7 is electrically connected to the pull-up node PU, and the source of the seventh transistor M7 is electrically connected to a second reference voltage end VGH. The second reference voltage end VGH is configured to provide the second reference voltage Vgh required by a display unit, such as 4.5~7V. In this embodiment, the seventh transistor M7 is a Low Temperature Polycrystalline Oxide (LTPO) transistor, and the seventh transistor M7 can be a pull-up transistor. When the seventh transistor M7 is the P-type LTPO transistor, the seventh transistor M7 is in a conducting state under the control of a received low-level pull-up signal PURST during the pull-down phase T3 and the maintenance phase. That is, when the seventh transistor M7 is the P-type LTPO transistor, the seventh transistor M7 is switched on under the control of a received low-level pull-up signal PURST during the pull-down phase T3 and the maintenance phase.

In other embodiments of this disclosure, the seventh transistor M7 can also be an N-type Oxide thin-film transistor (TFT), which can be switched on under the control of a received high-level pull-up signal PURST during the pull-down phase T3 and the maintenance phase.

The pull-down unit 112 includes a sixth transistor M6 which includes a gate, a drain and a source. The gate of the sixth transistor M6 receives the reset signal CLKRST, the source of the sixth transistor M6 is electrically connected a first reference voltage end VGL, and the drain of the sixth transistor M6 is electrically connected to the pull-up node PU. In this embodiment, the sixth transistor M6 is a TFT, and the sixth transistor M6 can be a pull-down transistor. The first reference voltage end VGL provides the first reference voltage Vgl.

The switch unit 113 includes a eighth transistor M8 which includes a gate, a drain and a source. The gate of the eighth transistor M8 receives the switch control signal HOLD, the source of the eighth transistor M8 is electrically connected to the second reference voltage end VGH, and the drain of the eighth transistor M8 is electrically connected to the first output control unit 114. In this embodiment, the eighth transistor M8 is an N-type oxide thin-film transistor, and the eighth transistor M8 can be a switching transistor.

Specifically, the N-type oxide thin-film transistor can be a ZnO TFT, a GaZnO TFT, an InZnO TFT, an AlZnO TFT, an InGaZnO TFT, or an IGZO TFT. Moreover, the N-type oxide thin-film transistor can be an N-type thin-film transistor made from multiple metal-oxide thin-film materials including ZnO, GaZnO, InZnO, AlZnO, InGaZnO, and IGZO, or can also be an N-type thin-film transistor made by stacking and combining at least two layers of the metal-oxide thin-film materials.

The first output control unit 114 includes a fifth transistor M5 which includes a gate, a drain and a source. The gate of the fifth transistor M5 is electrically connected to the pull-up node PU, the source of the fifth transistor M5 is electrically connected to the switch unit 113, and the drain of the fifth transistor M5 is electrically connected to the pull-down node PD. In this embodiment, the fifth transistor M5 is a P-type LTPO transistor, and the fifth transistor M5 can be a first output control transistor. When the fifth transistor M5 is the P-type LTPO transistor, the fifth transistor M5 is in the conducting state under the control of low-voltage of the pull-up node PU during the maintenance phase to output the second reference voltage Vgh to the pull-down node PD in order to control the pull-down output unit 118 to be under a cut-off state. That is to say, when the fifth transistor M5 is the P-type LTPO transistor, the fifth transistor M5 is switched on under the control of low-voltageof the pull-up node PU during the maintenance phase to output the second reference voltage Vgh to the pull-down node PD, in order to control the pull-down output unit 118 to be switched off.

In other embodiments of this disclosure, the fifth transistor M5 can also be an N-type TFT, which can be switched on under the control of high-voltage of the pull-up node PU during the maintenance phase to output the second reference voltage Vgh to the pull-down node PD, in order to control the pull-down output unit 118 to be under the cut-off state.

The start unit 115 includes a first transistor M1 which includes a gate, a drain and a source. The gate and the source of the first transistor M1 are electrically connected and simultaneously receive the initial signal En, and the drain of the first transistor M1 is electrically connected to the pull-down node PD. That is, the first transistor M1 appears as a diode connection, in other words, the first transistor M1 is designed as a type of diode connection. In this embodiment, the first transistor M1 is the P-type LTPO transistor, and the first transistor M1 can be a start transistor.

The second output control unit 116 includes a fourth transistor M4 which includes a gate, a drain and a source. The gate of the fourth transistor M4 is electrically connected to the pull-down node PD, the source of the fourth transistor M4 is electrically connected to the second reference voltage end VGH, and the drain of the fourth transistor M4 is electrically connected to the pull-up node PU. In this embodiment, the fourth transistor M4 is the P-type LTPO transistor, and the fourth transistor M4 can be a second output control transistor. When the fourth transistor M4 is the P-type LTPO transistor, the fourth transistor M4 is in the conducting state under the control of low-voltage of the pull-down node PD during the scan signal output phase, and outputs the second reference voltage Vgh to the pull-up node PU. That is, when the fourth transistor M4 is the P-type LTPO transistor, the fourth transistor M4 is switched on under the control of low-voltage of the pull-down node PD during the scan signal output phase, and outputs the second reference voltage Vgh to the pull-up node PU.

In other embodiments of this disclosure, the fourth transistor M4 can also be an N-type oxide thin-film transistor, which can be switched on under the control of high-voltage of the pull-down node PD during the scan signal output phase and can output the second reference voltage Vgh to the pull-up node PU.

The pull-up output unit 117 includes a second transistor M2 which includes a gate, a drain and a source. The gate of the second transistor M2 is electrically connected to the pull-up node PU, the source of the second transistor M2 is electrically connected to the second reference voltage end VGH, and the drain of the second transistor M2 is electrically connected to the output end OUT. In this embodiment, the second transistor M2 is the P-type LTPO transistor, and the second transistor M2 can be a pull-up output transistor.

The pull-down output unit 118 includes a third transistor M3 and a capacitor C1. The third transistor M3 includes a gate, a drain and a source. The gate of the third transistor M3 is electrically connected to the pull-down node PD, the source of the third transistor M3 receives the clock signal CLKB, and the drain of the third transistor M3 is electrically connected to output end OUT. The capacitor C1 is electrically connected between the pull-down node PD and the output end OUT. In this embodiment, the third transistor M3 is the P-type LTPO transistor, and the third transistor M3 can be a pull-down output transistor.

In detail, the transistors in the pull-up unit 111, the pull-down unit 112, the first output control unit 114, the start unit 115, the second output control unit 116, the pull-up output unit 117 and the pull-down output unit 118 are all the P-type LTPO transistors. The source of the P-type LTPO transistor can accurately receive the second reference voltage Vgh as a fixed value, and the larger the driving current of the P-type transistor is, the more the border area occupied by drive circuits can be reduce.

The N-type oxide thin-film transistor is used in the switch unit 113, therefore, the leakage current of the TFT in the switch unit 113 is small, which can effectively prevent the pull-up node PU from voltage and current interference. At the same time, the voltage and the current of the pull-up node PU can be better protected, and the leakage current of the pixel scan drive circuit is overall small, so that the pixel scan drive circuit can drive display refresh of the image data at a low frequency or a high frequency.

Figure 7:
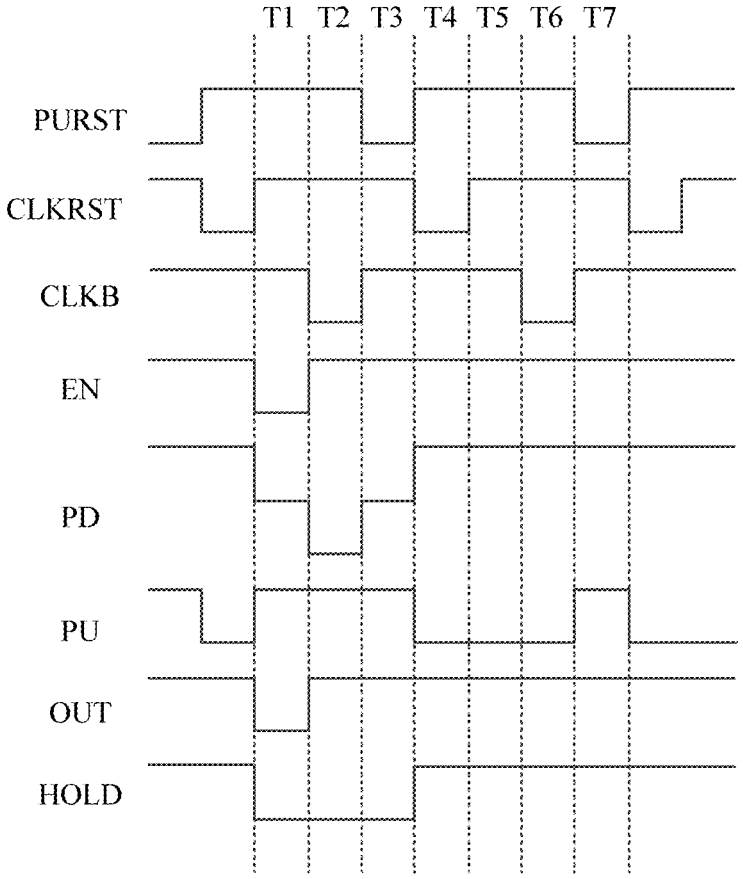
FIG. 7 is a timing diagram of the pixel scan drive circuit during an image display process of one frame as shown in FIG. 6.

Please refer to FIG. 7, which is a timing diagram of the pixel scan drive circuit 100 during an image display process of one frame as shown in FIG. 6. As shown in FIG. 7, PURST and CLKRST respectively represent signal waveforms of the pull-up signal PURST and the reset signal CLKRST. CLKB represents the signal waveform of the clock signal CLKB. EN represents the signal waveform of the initial signal En. PD and PU respectively represent voltage waveforms of the pull-down node PD and the pull-up node PU. In detail, the voltage of the pull-down node PD can be a first level, a second level and a third level. OUT represents the voltage waveform of the output end OUT. HOLD represents the signal waveform of the switch control signal HOLD. The voltage of the third level is less than the voltage of the second level, and the voltage of the second level is less than the voltage of the first level. The voltage of the first level is equal to the high level of other signals, and the voltage of the second is equal to the low level of the other signals. The other signals can be the pull-up signal PURST, the reset signal CLKRST, the clock signal CLKB, the initial signal En and the switch control signal HOLD.

Figure 8:
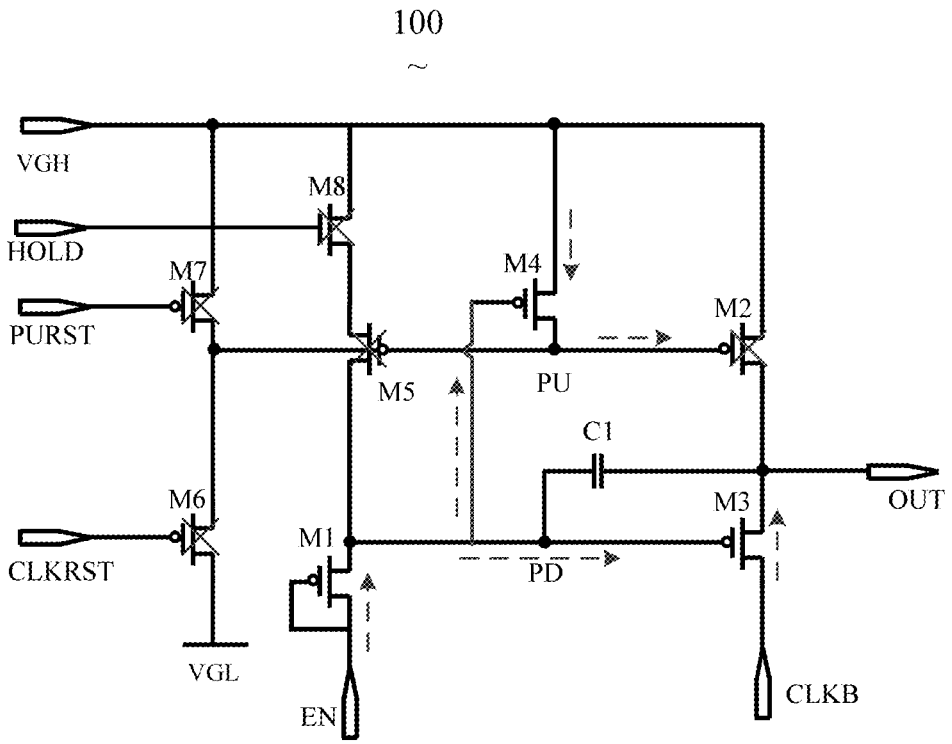
FIG. 8 is a diagram of circuit working condition of the pixel scan drive circuit in an initial phase as shown in FIG. 6.

Please refer to FIGS. 7 and 8, FIG. 8 is a diagram of circuit working condition of the pixel scan drive circuit in an initial phase as shown in FIG. 6.

In the initial phase T1, the pull-up signal PURST, the reset signal CLKRST, the clock signal CLKB and the pull-up node PU are all at the high level, the initial signal En and the switch control signal HOLD are both at the low level, and the pull-down node PD is at the second level.

Thus, the seventh transistor M7 of the pull-up unit 111 is in the cut-off state under the control of the pull-up signal PURST, namely, the seventh transistor M7 is switched off under the control of the pull-up signal PURST. The sixth transistor M6 of the pull-down unit 112 is in the cut-off state under the control of the reset signal CLKRST, namely, the sixth transistor M6 is switched off under the control of the reset signal CLKRST. The eighth transistor M8 of the switch unit 113 is in the cut-off state under the control of the switch control signal HOLD, namely, the eighth transistor M8 is switched off under the control of the switch control signal HOLD. The fifth transistor M5 of the first output control unit 114 is in the cut-off state under the control of the pull-up node PU, namely, the fifth transistor M5 is switched off under the control of the pull-up node PU. The first transistor M1 of the start unit 115 is in the conducting state under the control of the initial signal En, namely, the first transistor M1 is switched on under the control of the initial signal En. The fourth transistor M4 of the second output control unit 116 is in the conducting state under the control of the voltage of the pull-down node PD, namely, the fourth transistor M4 is switched on under the control of the voltage of the pull-down node PD. The second transistor M2 of the pull-up output unit 117 is in the cut-off state under the control of the voltage of the pull-up node PU, namely, the second transistor M2 is switched off under the control of the voltage of the pull-up node PU. The third transistor M3 of the pull-down output unit 118 is in the conducting state under the control of the voltage of the pull-down node PD, namely, the third transistor M3 is switched on under the control of the voltage of the pull-down node PD.

Since the first transistor M1 is in the conducting state, the pull-down node PD is in the second level, the clock signal CLKB is transmitted to the capacitor C1 through the third transistor M3, the fourth transistor M4 is in the conducting state, and the pull-up node PU is at the high level.

Figure 9:
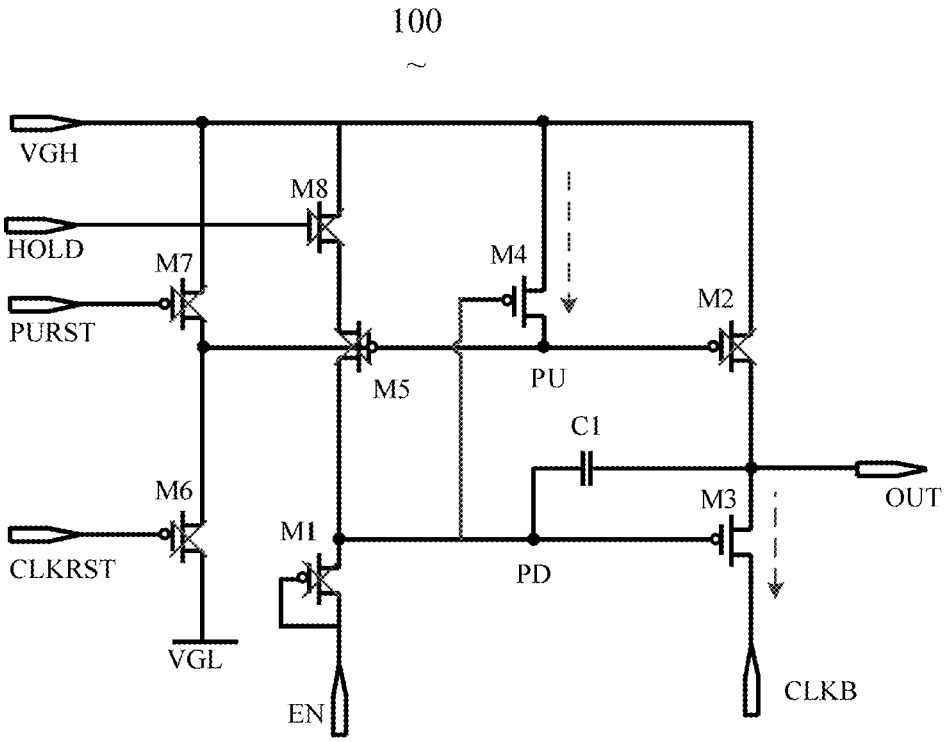
FIG. 9 is a diagram of circuit working condition of the pixel scan drive circuit in a scanning phase as shown in FIG. 6.

Please refer to FIGS. 7 and 9, FIG. 9 is a diagram of circuit working condition of the pixel scan drive circuit in a scanning phase as shown in FIG. 6.

In the scanning phase T2, the pull-up signal PURST, the reset signal CLKRST, the initial signal En and the pull-up node PU are all at the high level, the clock signal CLKB and the switch control signal HOLD are both at the low level, and the pull-down node PD is at the third level.

Thus, the seventh transistor M7 of the pull-up unit 111 is in the cut-off state under the control of the pull-up signal PURST, namely, the seventh transistor M7 is switched off under the control of the pull-up signal PURST. The sixth transistor M6 of the pull-down unit 112 is in the cut-off state under the control of the reset signal CLKRST, namely, the sixth transistor M6 is switched off under the control of the reset signal CLKRST. The eighth transistor M8 of the switch unit 113 is in the cut-off state under the control of the switch control signal HOLD, namely, the eighth transistor M8 is switched off under the control of the switch control signal HOLD. The fifth transistor M5 of the first output control unit 114 is in the cut-off state under the control of the pull-up node PU, namely, the fifth transistor M5 is switched off under the control of the pull-up node PU. The first transistor M1 of the start unit 115 is in the cut-off state under the control of the initial signal En, namely, the first transistor M1 is switched off under the control of the initial signal En. The fourth transistor M4 of the second output control unit 116 is in the conducting state under the control of the voltage of the pull-down node PD, namely, the fourth transistor M4 is switched on under the control of the voltage of the pull-down node PD. The second transistor M2 of the pull-up output unit 117 is in the cut-off state under the control of the voltage of the pull-up node PU, namely, the second transistor M2 is switched off under the control of the voltage of the pull-up node PU. Since the clock signal CLKB is at the low level, the output end OUT is at the high level, therefore, a current direction in the third transistor M3 of the pull-down output unit 118 is from the drain to the source, that is, the current in the third transistor M3 of the pull-down output unit 118 flows from the drain to the source.

Since the first transistor M1 is in the cut-off state, the third transistor M3 can be used as a single-guide diode under the control of the clock signal CLKB, and the current in the third transistor M3 flows from the output end OUT connected to the drain of the third transistor M3 to the source of the third transistor M3. Therefore, the output end OUT changes from the high level to the low level. The pull-down node PD is changed from the second level to the third level under the control of the capacitor C1, therefore controlling the third transistor M3 and the fourth transistor M4 in the conducting state.

Figure 10:
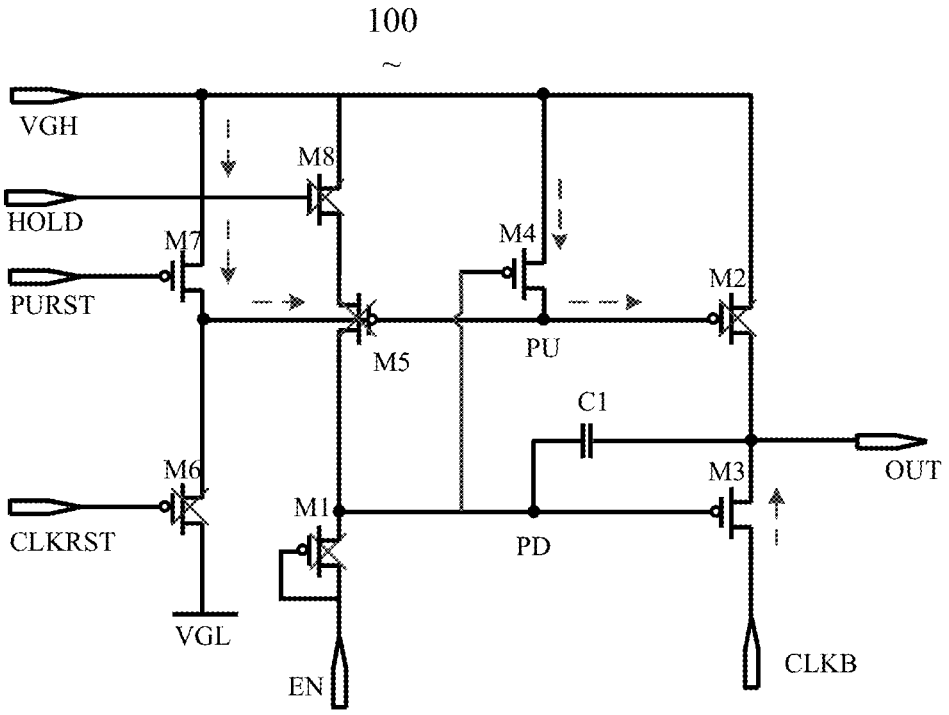
FIG. 10 is a diagram of circuit working condition of the pixel scan drive circuit in a pull-down phase as shown in FIG. 6.

Please refer to FIG. 7 and FIG. 10, FIG. 10 is a diagram of circuit working condition of the pixel scan drive circuit in a pull-down phase as shown in FIG. 6.

In the pull-down phase T3, the reset signal CLKRST, the clock signal CLKB, the initial signal En and the pull-up node PU are all at the high level, the pull-up signal PURST and the switch control signal HOLD are both at the low level, and the pull-down node PD is at the second level.

Thus, the seventh transistor M7 of the pull-up unit 111 is in the conducting state under the control of the pull-up signal PURST, namely, the seventh transistor M7 is switched on under the control of the pull-up signal PURST. The sixth transistor M6 of the pull-down unit 112 is in the cut-off state under the control of the reset signal CLKRST, namely, the sixth transistor M6 is switched off under the control of the reset signal CLKRST. The eighth transistor M8 of the switch unit 113 is in the cut-off state under the control of the switch control signal HOLD, namely, the eighth transistor M8 is switched off under the control of the switch control signal HOLD. The fifth transistor M5 of the first output control unit 114 is in the cut-off state under the control of the pull-up node PU, namely, the fifth transistor M5 is switched off under the control of the pull-up node PU. The first transistor M1 of the start unit 115 is in the cut-off state under the control of the initial signal En, namely, the first transistor M1 is switched off under the control of the initial signal En. The fourth transistor M4 of the second output control unit 116 is in the conducting state under the control of the voltage of the pull-down node PD, namely, the fourth transistor M4 is switched on under the control of the voltage of the pull-down node PD. The second transistor M2 of the pull-up output unit 117 is in the cut-off state under the control of the voltage of the pull-up node PU, namely, the second transistor M2 is switched off under the control of the voltage of the pull-up node PU. The third transistor M3 of the pull-down output unit 118 is in the conducting state under the control of the voltage of the pull-down node PD, namely, the third transistor M3 is switched on under the control of the voltage of the pull-down node PD.

When the clock signal CLKB changes from the low level to the high level, the pull-down node is at the third level, and the output end OUT is at the low level. Thus, the third transistor M3 is switched on, the output end OUT changes from the low level to the high level, and the voltage of the pull-down node PD changes from the third level to the second level through the capacitor C1. To ensure that the second transistor M2 of the pull-up output unit 117 is in the cut-off state, the seventh transistor M7 in the pull-up unit 111 is in the conducting state under the control of the pull-up signal PURST to ensure that the pull-up node PU remains at the high level.

Figure 11:
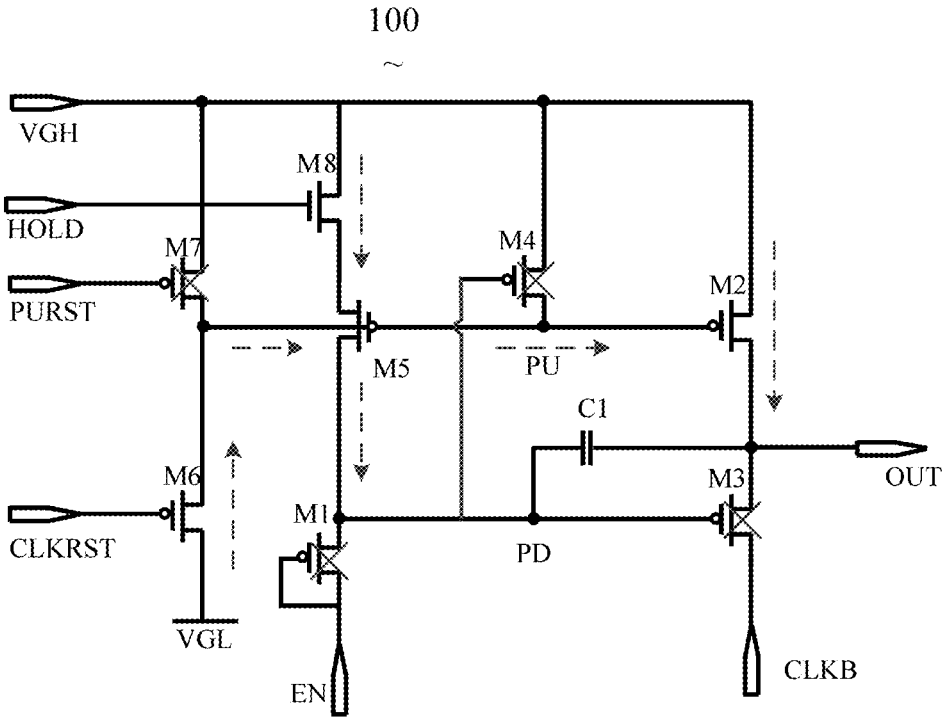
FIG. 11 is a diagram of circuit working condition of the pixel scan drive circuit in a reset phase as shown in FIG. 6.

Please refer to FIG. 7 and FIG. 11, FIG. 11 is a diagram of circuit working condition of the pixel scan drive circuit in a reset phase as shown in FIG. 6.

In the reset phase T4, the pull-up signal PURST, the clock signal CLKB, the initial signal En and the switch control signal HOLD are all at the high level, the reset signal CLKRST and the pull-up node PU are both at the low level, and the pull-down node PD is at the first level.

Thus, the seventh transistor M7 of the pull-up unit 111 is in the cut-off state under the control of the pull-up signal PURST, namely, the seventh transistor M7 is switched off under the control of the pull-up signal PURST. The sixth transistor M6 of the pull-down unit 112 is in the conducting state under the control of the reset signal CLKRST, namely, the sixth transistor M6 is switched on under the control of the reset signal CLKRST. The eighth transistor M8 of the switch unit 113 is in the conducting state under the control of the switch control signal HOLD, namely, the eighth transistor M8 is switched on under the control of the switch control signal HOLD. The fifth transistor M5 of the first output control unit 114 is in the conducting state under the control of the pull-up node PU, namely, the fifth transistor M5 is switched on under the control of the pull-up node PU. The first transistor M1 of the start unit 115 is in the cut-off state under the control of the initial signal En, namely, the first transistor M1 is switched off under the control of the initial signal En. The fourth transistor M4 of the second output control unit 116 is in the cut-off state under the control of the voltage of the pull-down node PD, namely, the fourth transistor M4 is switched off under the control of the voltage of the pull-down node PD. The second transistor M2 of the pull-up output unit 117 is in the conducting state under the control of the voltage of the pull-up node PU, namely, the second transistor M2 is switched on under the control of the voltage of the pull-up node PU. The third transistor M3 of the pull-down output unit 118 is in the cut-off state under the control of the voltage of the pull-down node PD, namely, the third transistor M3 is switched off under the control of the voltage of the pull-down node PD.

Since the sixth transistor M6 is switched on under the control of the reset signal CLKRST, the pull-up node PU is changed from the high level to the low level, and the second transistor M2 is switched on. Thus, the second reference voltage Vgh is output to the output end OUT through the second transistor M2. Because the fifth transistor M5 and the eighth transistor M8 are switched on, therefore, the pull-down node PD is at the first level, namely, the high level, the third transistor M3 is switched off to avoid the output end OUT from being affected by the clock signal.

Figure 12:
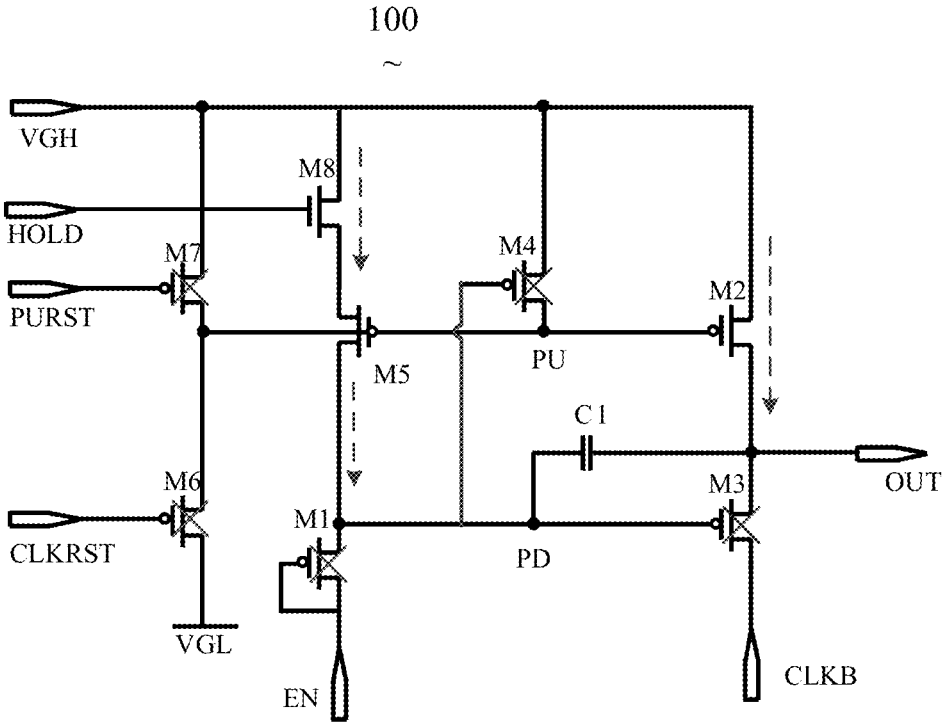
FIG. 12 is a diagram of circuit working condition of the pixel scan drive circuit in a first maintenance phase as shown in FIG. 6.

Please refer to FIGS. 7 and 12, FIG. 12 is a diagram of circuit working condition of the pixel scan drive circuit in a first maintenance phase as shown in FIG. 6.

In the first maintenance phase T5, the pull-up signal PURST, the reset signal CLKRST, the clock signal CLKB, the initial signal En, the pull-down node PD and the switch control signal HOLD are all at the high level, and the pull-up node PU is at the low level.

Thus, the seventh transistor M7 of the pull-up unit 111 is in the cut-off state under the control of the pull-up signal PURST, namely, the seventh transistor M7 is switched off under the control of the pull-up signal PURST. The sixth transistor M6 of the pull-down unit 112 is in the cut-off state under the control of the reset signal CLKRST, namely, the sixth transistor M6 is switched off under the control of the reset signal CLKRST. The eighth transistor M8 of the switch unit 113 is in the conducting state under the control of the switch control signal HOLD, namely, the eighth transistor M8 is switched on under the control of the switch control signal HOLD. The fifth transistor M5 of the first output control unit 114 is in the conducting state under the control of the pull-up node PU, namely, the fifth transistor M5 is switched on under the control of the pull-up node PU. The first transistor M1 of the start unit 115 is in the cut-off state under the control of the initial signal En, namely, the first transistor M1 is switched off under the control of the initial signal En. The fourth transistor M4 of the second output control unit 116 is in the cut-off state under the control of the voltage of the pull-down node PD, namely, the fourth transistor M4 is switched off under the control of the voltage of the pull-down node PD. The second transistor M2 of the pull-up output unit 117 is in the conducting state under the control of the voltage of the pull-up node PU, namely, the second transistor M2 is switched on under the control of the voltage of the pull-up node PU. The third transistor M3 of the pull-down output unit 118 is in the cut-off state under the control of the voltage of the pull-down node PD, namely, the third transistor M3 is switched off under the control of the voltage of the pull-down node PD.

Since the eighth transistor M8 is an N-type TFT, therefore, the leakage current in the first output control unit 114 can be reduced, so that the pixel scan drive circuit has a better driving effect at the low frequency.

Figure 13:
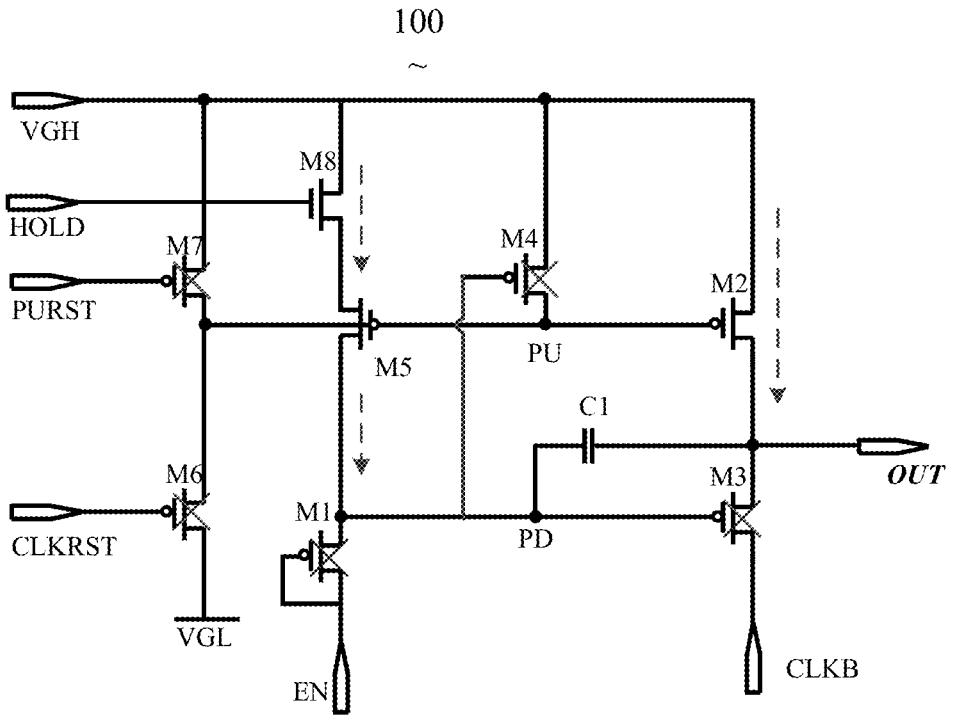
FIG. 13 is a diagram of circuit working condition of the pixel scan drive circuit in a second maintenance phase as shown in FIG. 6.

Please refer to FIG. 7 and FIG. 13, FIG. 13 is a diagram of circuit working condition of the pixel scan drive circuit in a second maintenance phase as shown in FIG. 6.

In the second maintenance phase T6, the pull-up signal PURST, the reset signal CLKRST, the initial signal En, the pull-down node PD and the switch control signal HOLD are all at the high level, and the clock signal CLKB and the pull-up node PU are both at the low level.

Thus, the seventh transistor M7 of the pull-up unit 111 is in the cut-off state under the control of the pull-up signal PURST, namely, the seventh transistor M7 is switched off under the control of the pull-up signal PURST. The sixth transistor M6 of the pull-down unit 112 is in the cut-off state under the control of the reset signal CLKRST, namely, the sixth transistor M6 is switched off under the control of the reset signal CLKRST. The eighth transistor M8 of the switch unit 113 is in the conducting state under the control of the switch control signal HOLD, namely, the eighth transistor M8 is switched on under the control of the switch control signal HOLD. The fifth transistor M5 of the first output control unit 114 is in the conducting state under the control of the pull-up node PU, namely, the fifth transistor M5 is switched on under the control of the pull-up node PU. The first transistor M1 of the start unit 115 is in the cut-off state under the control of the initial signal En, namely, the first transistor M1 is switched off under the control of the initial signal En. The fourth transistor M4 of the second output control unit 116 is in the cut-off state under the control of the voltage of the pull-down node PD, namely, the fourth transistor M4 is switched off under the control of the voltage of the pull-down node PD. The second transistor M2 of the pull-up output unit 117 is in the conducting state under the control of the voltage of the pull-up node PU, namely, the second transistor M2 is switched on under the control of the voltage of the pull-up node PU. The third transistor M3 of the pull-down output unit 118 is in the cut-off state under the control of the voltage of the pull-down node PD, namely, the third transistor M3 is switched off under the control of the voltage of the pull-down node PD.

In the first maintenance phase T5 and the second maintenance phase T5, the eighth transistor M8 is switched on under the control of the switch control signal HOLD, and the second transistor M2 in the pull-up output unit 117 can output the second reference voltage Vgh, which is not affected by the third transistor M3 in the pull-down output unit 118, in order to maintain output stability of drive signals.

Figure 14:
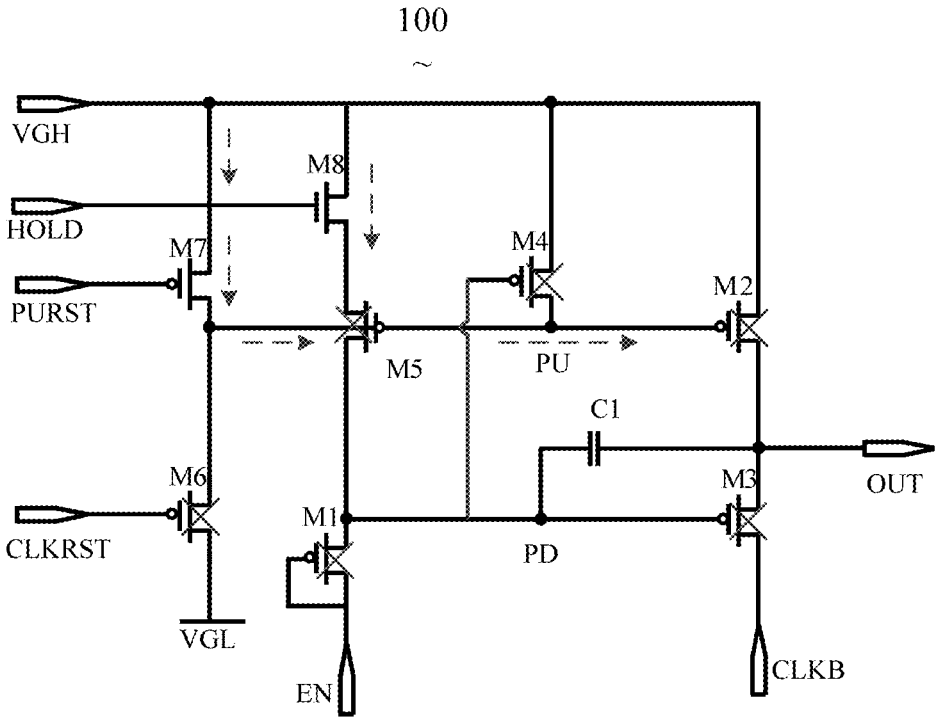
FIG. 14 is a diagram of circuit working condition of the pixel scan drive circuit in a pull-up phase as shown in FIG. 6.

Please refer to FIGS. 4 and 14, FIG. 14 is a diagram of circuit working condition of the pixel scan drive circuit in a pull-up phase as shown in FIG. 6.

In the pull-up phase T7, the reset signal CLKRST, the clock signal CLKB, the initial signal En, the pull-down node PD, the pull-up node PU and the switch control signal HOLD are all at the high level, and the pull-up signal PURST is at the low level.

Thus, the seventh transistor M7 of the pull-up unit 111 is in the conducting state under the control of the pull-up signal PURST, namely, the seventh transistor M7 is switched on under the control of the pull-up signal PURST. The sixth transistor M6 of the pull-down unit 112 is in the cut-off state under the control of the reset signal CLKRST, namely, the sixth transistor M6 is switched off under the control of the reset signal CLKRST. The eighth transistor M8 of the switch unit 113 is in the conducting state under the control of the switch control signal HOLD, namely, the eighth transistor M8 is switched on under the control of the switch control signal HOLD. The fifth transistor M5 of the first output control unit 114 is in the cut-off state under the control of the pull-up node PU, namely, the fifth transistor M5 is switched off under the control of the pull-up node PU. The first transistor M1 of the start unit 115 is in the cut-off state under the control of the initial signal En, namely, the first transistor M1 is switched off under the control of the initial signal En. The fourth transistor M4 of the second output control unit 116 is in the cut-off state under the control of the voltage of the pull-down node PD, namely, the fourth transistor M4 is switched off under the control of the voltage of the pull-down node PD. The second transistor M2 of the pull-up output unit 117 is in the cut-off state under the control of the voltage of the pull-up node PU, namely, the second transistor M2 is switched off under the control of the voltage of the pull-up node PU. The third transistor M3 of the pull-down output unit 118 is in the cut-off state under the control of the voltage of the pull-down node PD, namely, the third transistor M3 is switched off under the control of the voltage of the pull-down node PD.

In this embodiment, in the second maintenance phase T6 and the pull-up phase T7, the switch control signal HOLD can be the low level or the high level.

In the image display process of one frame by the display panel, electronic components in each functional unit of the pixel scan drive circuit work at a fixed phase to avoid long-term charging and discharging, which can reduce the loss of the electronic components in the pixel scan drive circuit, and extend the service life of the electronic components.

Figure 15:
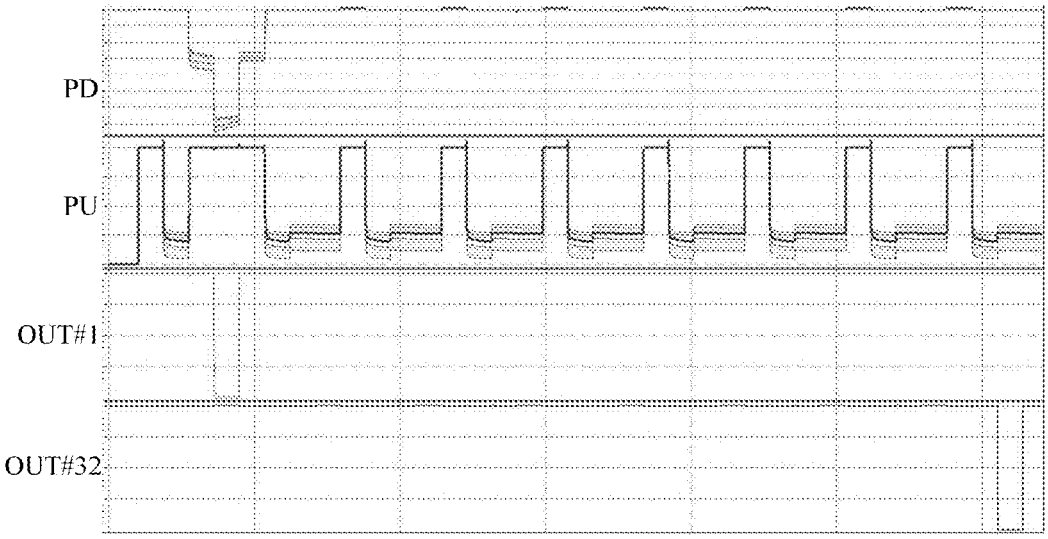
FIG. 15 is a timing simulation diagram of the pixel scan drive circuit during the image display process as shown in FIG. 6.

Please refer to FIG. 15, which is a timing simulation diagram of the pixel scan drive circuit during the image display process as shown in FIG. 6. As shown in FIG. 15, PD represents a timing potential simulation diagram of the pull-down node PD. PU represents a timing potential simulation diagram of the pull-up node PU. OUT #1 represents a timing potential simulation diagram of the first scan line G1, and OUT #32 represents a timing potential simulation diagram of the 32nd scan line G32 (as shown in FIG. 2). The output end OUT remains at the high level in non-output phases, while the output end OUT remains at the low level in output phases, which is consistent with the timing sequence of the output end OUT in the timing diagram (as shown in FIG. 7).

Figure 16:
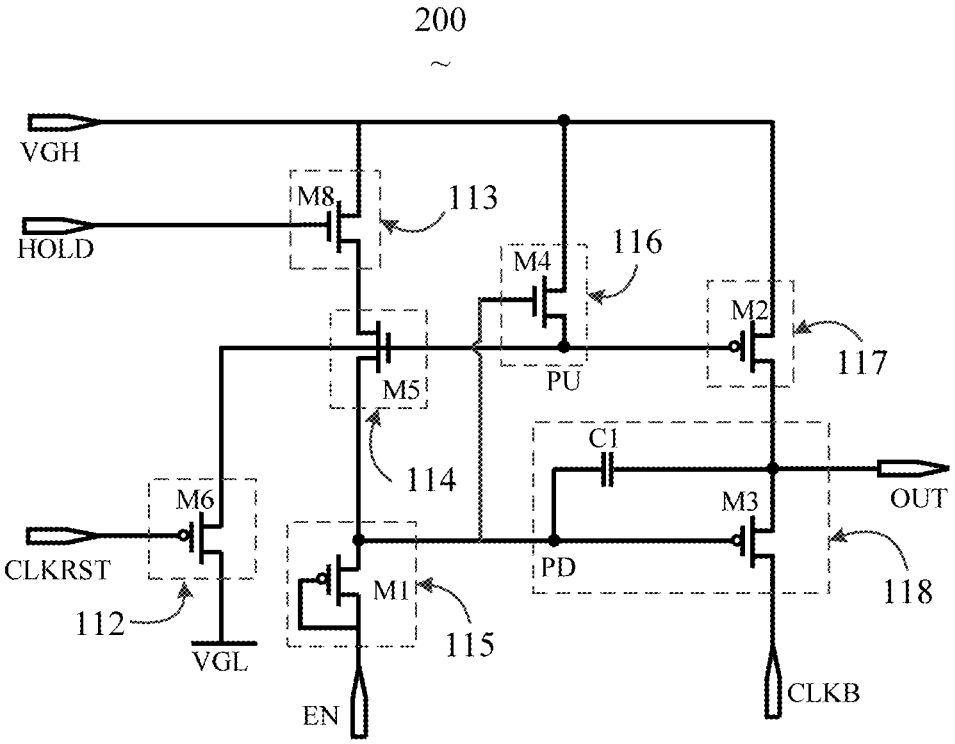
FIG. 16 is a circuit block diagram of a pixel scan drive circuit in the scan driver module as shown in FIG. 2 according to a second embodiment of the present disclosure.

Please refer to FIG. 16, which is a circuit block diagram of a pixel scan drive circuit 200 in the scan driver module as shown in FIG. 2 according to a second embodiment of the present disclosure. As shown in FIG. 16, the pixel scan drive circuit 200 of the second embodiment and the pixel scan drive circuit 100 of the first embodiment basically have the same circuit structure and working principle, the difference is that the pixel scan drive circuit 200 does not include the pull-up unit 111, that is, the pixel scan drive circuit 200 in the second embodiment includes a pull-down unit 112, a switch unit 113, a first output control unit 114, a start unit 115, a second output control unit 116, a pull-up output unit 117, and a pull-down output unit 118.

The pull-down unit 112 is electrically connected to the first output control unit 114 and is configured to receive the reset signal CLKRST in the reset phase T4 and transmit the first reference voltage Vgl to the pull-up node PU, and control the pull-up node PU from the high level to the low level.

The switch unit 113 is electrically connected between the second reference voltage end VGH and the first output control unit 114. The switch unit 113 is configured to transmit the second reference voltage Vgh to the first output control unit 114 according to received switch control signal HOLD during the reset phase T4 to the pull-up phase T7.

The first output control unit 114 is electrically connected to the second output control unit 116, and is configured to transmit the second reference voltage Vgh to the pull-down node PD according to the voltage of the pull-up node PU during the reset phase T4 to the second maintenance phase T6 and control the pull-down node PD to rise from the low level to the high level.

The start unit 115 is electrically connected to the second output control unit 116 and the pull-down output unit 118. The start unit 115 is configured to control the pull-down node PD from the high level to the low level based on received initial signal En in the initial phase T1.

The second output control unit 116 is electrically connected to the second reference voltage end VGH and the pull-up output unit 117. The second output control unit 116 is configured to transmit the second reference voltage Vgh to the pull-up node PU according to the voltage of the pull-down node PD during the initial phase T1 to the pull-down phase T3 and control the pull-up node PU to rise from the low level to the high level.

The pull-up output unit 117 is electrically connected to the second reference voltage end VGH and the output end OUT. The pull-up output unit 117 is configured to transmit the second reference voltage Vgh to the output end OUT according to the voltage of the pull-up node PU during the reset phase T4 to the second maintenance phase T6.

The pull-down output unit 118 is electrically connected to the second output control unit 116 and the output end OUT. The pull-down output unit 118 is configured to control the clock signal CLKB output to the output end OUT according to the voltage of the pull-down node PD during the initial phase T1 to the pull-down phase T3.

Specifically, the pull-up node PU can be used as an input control end of the first output control unit 114 and an output control end of the pull-up output unit 117. The pull-down node PD can be used as an input control end of the second output control unit 116 and an input control end of the pull-down output unit 118.

In detail, as shown in FIG. 16, the pull-down unit 112 includes a sixth transistor M6 which includes a gate, a source and a drain. The gate of the sixth transistor M6 receives the reset signal CLKRST, the source of the sixth transistor M6 is electrically connected to the first reference voltage end VGL, and the drain of the sixth transistor M6 is electrically connected to the pull-up node PU. In this embodiment, the sixth transistor M6 is a P-type LTPO transistor, and the sixth transistor M6 can be a pull-down transistor.

The switch unit 113 includes an eighth transistor M8 which includes a gate, a source and a drain. The gate of the eighth transistor M8 receives the switch control signal HOLD, the source of the eighth transistor M8 is electrically connected to the second reference voltage end VGH, and the drain of the eighth transistor M8 is electrically connected to the first output control unit 114. In this embodiment, the eighth transistor M8 is an N-type oxide thin-film transistor, and the eighth transistor M8 can be a switching transistor. The second reference voltage end VGH can be configured to provide the second reference voltage Vgh required by the display unit, such as 4.5~7V.

Specifically, the N-type oxide thin-film transistor can be a ZnO TFT, a GaZnO TFT, an InZnO TFT, an AlZnO TFT, an InGaZnO TFT, or an IGZO TFT. Moreover, the N-type oxide thin-film transistor can be an N-type thin-film transistor made from multiple metal-oxide thin-film materials including ZnO, GaZnO, InZnO, AlZnO, InGaZnO, and IGZO, or can also be an N-type thin-film transistor made by stacking and combining at least two layers of the metal-oxide thin-film materials.

The first output control unit 114 includes a fifth transistor M5 which includes a gate, a source and a drain. The gate of the fifth transistor M5 is electrically connected to the pull-up node PU, the source of the fifth transistor M5 is electrically connected to the switch unit 113, and the drain of the fifth transistor M5 is electrically connected to the pull-down node PD. In this embodiment, the fifth transistor M5 is an N-type oxide thin-film transistor. The fifth transistor M5 can be a second output control transistor.

The start unit 115 includes a first transistor M1 which includes a gate, a source and a drain. The gate and the source of the first transistor M1 are electrically connected directly and receive the initial signal En at the same time, and the drain of the first transistor M1 is electrically connected to the pull-down node PD. That is, the first transistor M1 appears as a diode connection, in other words, the first transistor M1 is designed as a type of diode connection. In this embodiment, the first transistor M1 is a P-type LTPO transistor, and the first transistor M1 can be a start transistor.

The second output control unit 116 includes a fourth transistor M4 which includes a gate, a drain and a source. The gate of the fourth transistor M4 is electrically connected to the pull-down node PD, the source of the fourth transistor M4 is electrically connected to the second reference voltage end VGH, and the drain of the fourth transistor M4 is electrically connected to the pull-up node PU. In this embodiment, the fourth transistor M4 is an N-type oxide thin-film transistor, and the fourth transistor M4 can be a second output control transistor.

The pull-up output unit 117 includes a second transistor M2 which includes a gate, a drain and a source. The gate of the second transistor M2 is electrically connected to the pull-up node PU, the source of the second transistor M2 is electrically connected to the second reference voltage end VGH, and the drain of the second transistor M2 is electrically connected to the output end OUT. In this embodiment, the second transistor M2 is a P-type LTPO transistor, and the second transistor M2 can be a pull-up output transistor.

The pull-down output unit 118 includes a third transistor M3 and a capacitor C1. The third transistor M3 includes a gate, a drain and a source. The gate of the third transistor M3 is electrically connected to the pull-down node PD, the source of the third transistor M3 receives the clock signal CLKB, and the drain of the third transistor M3 is electrically connected to output end OUT. The capacitor C1 is electrically connected between the pull-down node PD and the output end OUT. In this embodiment, the third transistor M3 is a P-type LTPO transistor, and specifically, the third transistor M3 can be a pull-down output transistor.

In particular, the transistors of the pull-down unit 112, the start unit 115, the pull-up output unit 117 and the pull-down output unit 118 are the P-type LTPO transistors. The source of P-type TFT can accurately receive the second reference voltage Vgh as a fixed value. The larger the driving current of the P-type TFT is, the more the border area occupied by the pixel scan drive circuit can be reduced.

The N-type oxide thin-film transistors are used in the switch unit 113, the first output control unit 114 and the second output control unit 116. Thus, by reducing the leakage current of the pull-up node PU itself, it can quickly adapt to the refresh rate of different image data when displaying at high and low speeds. Moreover, because the leakage current is small, the pixel scan drive circuit 200 can fully match and adapt to the drive mode of low-power mode consumption.

In other embodiments of this disclosure, mirroring circuits of the pixel scan drive circuits of the embodiments in this disclosure are also within the scope of this disclosure. For example, the channel types of all the transistors in FIG. 6 and FIG. 16 can be changed accordingly, for instance, the N-type transistors can be adjusted to the P-type transistors, and the P-type transistors can be adjusted to the N-type transistors. Accordingly, the person having ordinary skill in the art can also obtain corresponding mirrored pixel scan drive circuits according to the embodiments of this disclosure.

In this disclosure, specific embodiments are used to illustrate the principle and the embodiments of the present disclosure, and the above embodiments are only used to help understand the core idea of the present disclosure. It should be noted that for those of ordinary skill in the art, several improvements and retouches can be made without departing from the principles of the embodiments of the present disclosure, and these improvements and retouches are also regarded as the protection scope of the present disclosure.

What is claimed is:

1. A pixel scan drive circuit, configured to output a scan signal to pixel units, the pixel scan drive circuit comprising a switch unit, a pull-up output unit and a pull-down output unit, a scanning cycle in a display phase of one frame image comprising a scan signal output phase and a maintenance phase, wherein, in the scan signal output phase, the pull-down output unit outputs a first reference voltage in the scan signal to an output end according to a clock signal, the first reference voltage configured to control the pixel units to receive image data for image display;

the switch unit is electrically connected to the pull-down output unit; in the maintenance phase, the switch unit controls the voltage of a pull-down node according to a received switch control signal, thereby controlling the pull-down output unit to stop outputting the first reference voltage according to the voltage of the pull-down node, wherein the switch control signal is an input signal of the pixel scan drive circuit; in the maintenance phase, the pull-up output unit outputs a second reference voltage in the scan signal, and the second reference voltage is configured to control the pixel units to stop receiving the image data;

transistors comprised in the switch unit are of different types from transistors comprised in the pull-up output unit and the pull-down output unit, wherein the switch unit comprises a switch transistor, a gate of the switch transistor electrically connected to a switch control signal end to receive the switch control signal, a source of the switch transistor electrically connected to a second reference voltage end to receive the second reference voltage, a drain of the switch transistor electrically connected to a first output control unit, wherein the switch unit is configured to be switched on in the maintenance phase and transmit the second reference voltage to the first output control unit;

wherein the switch transistor is an N-type thin-film transistor, and the switch transistor is in a conducting state under the control of a high level in the switch control signal in the maintenance phase, wherein the first output control unit comprises a first output control transistor, a gate of the first output control transistor electrically connected to a pull-up node, a source of the first output control transistor electrically connected to the switch unit, a drain of the first output control transistor electrically connected to the pull-down node;

in the scan signal output phase, the first output control transistor is switched off under the control of the voltage of the pull-up node;

in the maintenance phase, the first output control transistor is switched on under the control of the voltage of the pull-up node and transmits the second reference voltage to the pull-down node, wherein the pull-down node is electrically connected to the pull-up node through a second output control unit, wherein in the scan signal output phase, the pull-down output unit outputs the first reference voltage under the control of the voltage of the pull-down node, the second output control unit transmitting the second reference voltage to the pull-up node under the control of the voltage of the pull-down node, so as to enable the pull-up output unit to stop outputting the second reference voltage under the voltage of the pull-up node.

2. The pixel scan drive circuit according to claim 1, wherein the switch unit is electrically connected to the pull-down node through the first output control unit, the first output control unit is electrically connected to the pull-up output unit through the pull-up node, wherein in the maintenance phase, the pull-up output unit outputs the second reference voltage under the control of the voltage of the pull-up node, and the first output control unit transmits the second reference voltage output by the switch unit to the pull-down node under the control of the voltage of the pull-up node, thereby controlling the pull-down output unit to stop outputting the first reference voltage.

3. The pixel scan drive circuit according to claim 1, wherein the first output control transistor is a P-type thin-film transistor or an N-type thin-film transistor;

when the first output control transistor is the P-type thin-film transistor, the first output control transistor is in a conducting state under the control of a low level of the pull-up node in the maintenance phase to output the second reference voltage to the pull-down node so as to control the pull-down output unit to be under a cut-off state;

when the first output control transistor is the N-type thin-film transistor, the first output control transistor is in the conducting state under the control of a high level of the pull-up node in the maintenance phase to output the second reference voltage to the pull-down node so as to control the pull-down output unit to be under the cut-off state.

4. The pixel scan drive circuit according to claim 3, wherein the N-type thin-film transistor is an N-type oxide transistor, the P-type thin-film transistor is a P-type low temperature polycrystalline oxide transistor;

the N-type oxide transistor at least comprises: one of an InGaZnO thin-film transistor, a GaZnO thin-film transistor, an InZnO thin-film transistor, an AlZnO thin-film transistor and a ZnO thin-film transistor, or a combination of a plurality of metal oxides, or a stack of multilayer thin films of various metal oxides.

5. The pixel scan drive circuit according to claim 1, wherein the second output control unit comprises a second output control transistor, a gate of the second output control transistor electrically connected to the pull-down node, a source of the second output control transistor electrically connected to the second reference voltage end to receive the second reference voltage, a drain of the second output control transistor electrically connected to the pull-up node;

in the scan signal output phase, the second output control transistor is switched on under the control of the voltage of the pull-down node, and the second reference voltage is transmitted to the pull-up node so as to control the pull-up output unit to stop outputting the second reference voltage to the output end.

6. The pixel scan drive circuit according to claim 5, wherein the second output control transistor is a P-type thin-film transistor or an N-type thin-film transistor;

when the second output control transistor is the P-type thin-film transistor, the second output control transistor is in a conducting state under the control of a low level of the pull-down node in the scan signal output phase, and the second reference voltage is transmitted to the pull-up node;

when the second output control transistor is the N-type thin-film transistor, the second output control transistor is in the conducting state under the control of a high level of the pull-down node in the scan signal output phase, and the second reference voltage is transmitted to the pull-up node.

7. The pixel scan drive circuit according to claim 1, wherein the scanning cycle further comprises an initial phase, wherein the initial phase, the scan signal output phase and the maintenance phase are arranged in a time sequence;

the pixel scan drive circuit further comprises a start unit electrically connected to the pull-down output unit and the second output control unit through the pull-down node, the start unit configured to control the voltage of the pull-down node to be an initial voltage in the initial phase, the initial voltage configured to control the pull-down output unit to in a conducting state and to output the clock signal.

8. The pixel scan drive circuit according to claim 7, wherein the start unit comprises a start transistor, a gate and a source of the start transistor electrically connected directly and receiving an initial signal, a drain of the start transistor electrically connected to the pull-down node, wherein in the initial phase, the start transistor is switched on and transmits the voltage of the initial signal to the pull-down node to control the pull-down output unit to be switched on;

wherein the start transistor is a P-type thin-film transistor, and the start transistor is in the conducting state under the control of a low level of the initial signal in the initial phase to control the pull-down node to be the first reference voltage and control the pull-down output unit to be switched on.

9. The pixel scan drive circuit according to claim 1, wherein the pull-up output unit comprises a pull-up output transistor, a gate of the pull-up output transistor electrically connected to the pull-up node, a source of the pull-up output transistor electrically connected to a second reference voltage end, a drain of the pull-up output transistor electrically connected the output end;

in the maintenance phase, the pull-up output transistor is switched on and transmits the second reference voltage to the output end;

wherein the pull-up output transistor is a P-type thin-film transistor, and the pull-up output transistor in a conducting state under the control of a low level of the pull-up node in the maintenance phase so as to output the second reference voltage to the output end.

10. The pixel scan drive circuit according to claim 1, wherein the pull-down output unit comprises a pull-down output transistor and a capacitor, a gate of the pull-down output transistor electrically connected to the pull-down node, a source of the pull-down output transistor receiving the clock signal, a drain of the pull-down output transistor electrically connected to the output end, wherein in the scan signal output phase, the pull-down output transistor is switched on to output the clock signal to the output end, wherein in the initial phase and the maintenance phase, the pull-down output transistor is switched off;

the capacitor is electrically connected between the pull-down node and the output end, and is configured to maintain the voltage of the pull-down node in the scan signal output phase to control the pull-down output transistor to be switched on;

wherein the pull-down output transistor is a P-type thin-film transistor, and the pull-down output transistor is switched on under the control of a low level of the pull-down node in the scan signal output phase, and outputs the clock signal to the output end.

11. The pixel scan drive circuit according to claim 1, wherein the scanning cycle further comprises a reset phase located between the scan signal output phase and the maintenance phase;

the pixel scan drive circuit further comprises a pull-down unit electrically connected to the pull-up output unit through the pull-up node, the pull-down unit configured to transmit the first reference voltage to the pull-up node according to a reset signal received in the reset phase to control the pull-up output unit to output the second reference voltage.

12. The pixel scan drive circuit according to claim 11, wherein the pull-down unit comprises a pull-down transistor, a gate of the pull-down transistor receiving the reset signal, a source of the pull-down transistor electrically connected to a first reference voltage end to receive the first reference voltage, a drain of the pull-down transistor electrically connected to the pull-up node;

the pull-down transistor is a P-type thin-film transistor, and the pull-down transistor is in a conducting state under the control of the low level of the reset signal in the reset phase, and the first reference voltage is transmitted to the pull-up node.

13. The pixel scan drive circuit according to claim 1, wherein the scanning cycle further comprises a pull-up phase located after the maintenance phase;

the pixel scan drive circuit further comprises a pull-up unit electrically connected to the pull-up output unit through the pull-up node, the pull-up unit configured to transmit the second reference voltage to the pull-up node according to a pull-up signal received in the pull-up phase and the maintenance phase to control the pull-up output unit to stop outputting the second reference voltage.

14. The pixel scan drive circuit according to claim 13, wherein the pull-up unit comprises a pull-up transistor, a gate of the pull-up transistor receiving the pull-up signal, a source of the pull-up transistor electrically connected to a second reference voltage end, a drain of the pull-up transistor electrically connected to the pull-up node, wherein the pull-up transistor is a P-type thin-film transistor or an N-type thin-film transistor;

when the pull-up transistor is the P-type thin-film transistor, the pull-up transistor is in a conducting state under the control of a low level of the pull-up signal received in the pull-up phase and the maintenance phase;

when the pull-up transistor is the N-type thin-film transistor, the pull-up transistor is in the conducting state under the control of a high level of the pull-up signal received in the pull-up phase and the maintenance phase.

15. The pixel scan drive circuit according to claim 1, wherein a refresh rate of the pixel scan drive circuit ranges at 1 Hz 120 Hz;

when the pixel scan drive circuit continuously outputs the scan signal to the pixel units, if the frequency of the switch control signal is changed, the refresh rate of the pixel scan drive circuit is dynamically adjusted.

16. An array substrate, comprising a display area and a non-display area, the display area provided with a plurality of pixel units, and the non-display area provided with a scan driver module, wherein the scan driver module comprises a plurality of pixel scan drive circuits according to claim 1, the plurality of pixel scan drive circuits cascading to each other.

17. A display terminal, comprising the array substrate according to claim 16.

* * * * *